US007825866B1

(12) United States Patent
Klein et al.

(10) Patent No.: US 7,825,866 B1
(45) Date of Patent: Nov. 2, 2010

(54) OMNI DIRECTIONAL SPACE-FED ANTENNA WITH LOOP PATTERNS

(76) Inventors: Joseph Klein, 20732 Lassen St., Chatsworth, CA (US) 91311; Vladimir Kimelblat, 20732 Lassen St., Chatsworth, CA (US) 91311

( * ) Notice: Subject to any disclaimer, the term of this patent is extended or adjusted under 35 U.S.C. 154(b) by 608 days.

(21) Appl. No.: 11/863,949

(22) Filed: Sep. 28, 2007

(51) Int. Cl.
*H01Q 11/12* (2006.01)

(52) U.S. Cl. ..... 343/741; 343/708; 343/726; 343/748

(58) Field of Classification Search ..... 343/741–744, 343/708, 726, 728, 748
See application file for complete search history.

(56) References Cited

U.S. PATENT DOCUMENTS 2,283,897 A 4/1939 Alford
2,368,618 A * 2/1945 Sandretto et al. ..... 343/743
2,642,529 A 7/1949 Frankel
2,501,430 A * 3/1950 Alford ..... 343/741
3,427,622 A 2/1969 Kandoian et al.
4,547,776 A * 10/1985 Bolt et al. ..... 343/741
4,726,927 A 2/1988 Morgan et al.
6,515,632 B1 2/2003 McLean
6,911,947 B1 * 6/2005 Cranor et al. ..... 343/741

* cited by examiner

*Primary Examiner*—Douglas W Owens
*Assistant Examiner*—Dieu Hien T Duong

(57) ABSTRACT

The present invention antenna preserves the general size and form factor of the prior art loop antennas while providing the benefits of multiple point feeds at less than one wavelength in separation of feed points. The invention antenna obtains omnidirectional radiation and improved efficiency over the prior art by way of dual slotted, open ended cylindrical or rectangular box structures fed with high impedance feed lines.

14 Claims, 4 Drawing Sheets

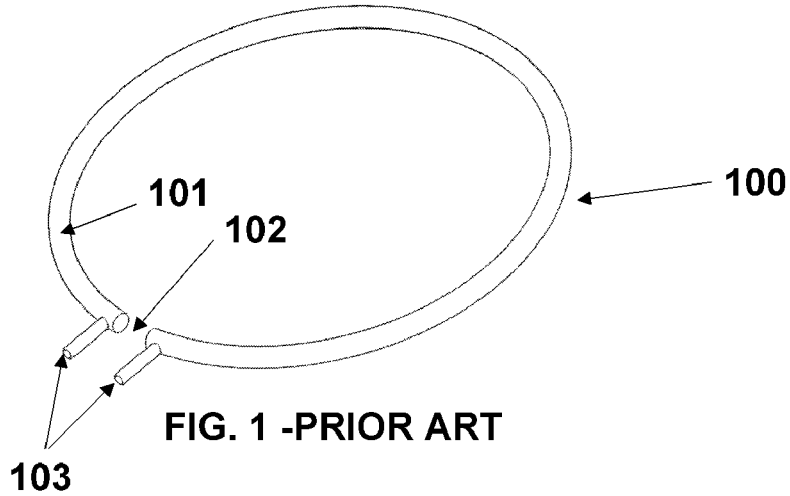
FIG. 1 -PRIOR ART
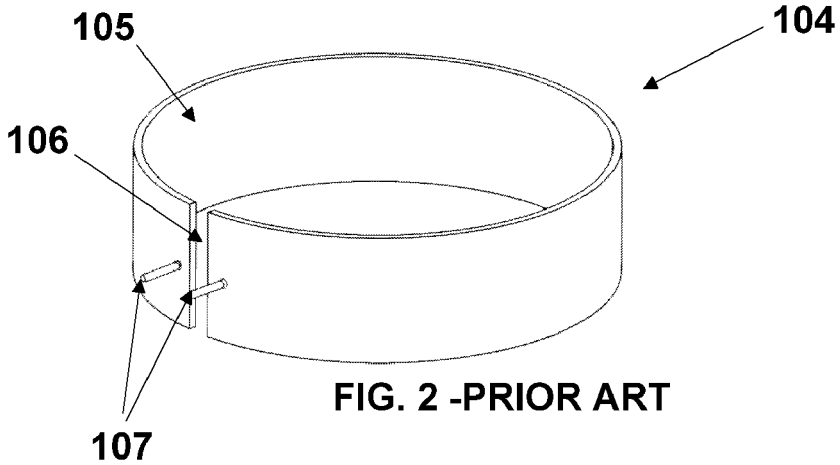
FIG. 2 -PRIOR ART
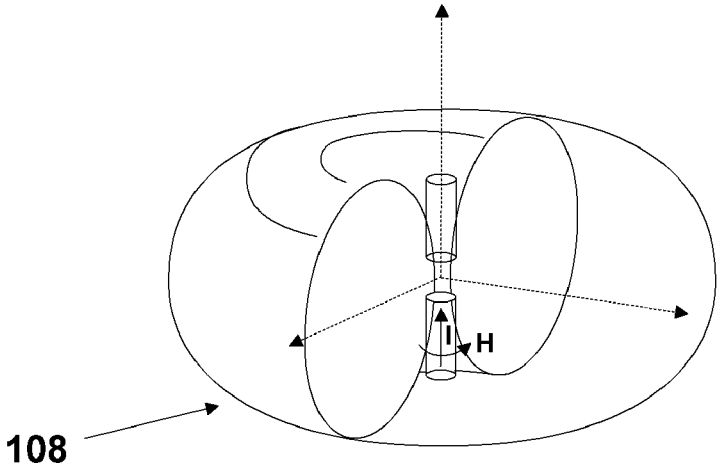
FIG. 3 -PRIOR ART

OMNI DIRECTIONAL SPACE-FED ANTENNA WITH LOOP PATTERNS

FIELD OF THE INVENTION

The present invention relates to loop or folded dipole antennas. More particularly, the invention relates to such antennas

BACKGROUND OF THE INVENTION

Loop or folded dipole antennas include simple circular or square loops, whose impedance is readily calculated. An example of a prior art circular loop antenna 100 is shown in FIG. 1 comprising a loop portion 101, gap 102, and input/output connections 103.

Antennas of resonant size, where the size is in the vicinity of a half wavelength, have been typically fed at one feed point with series or shunt structures. In series fed structures, a signal is fed to one side of a gap formed in the conductor loop. Signal feeding to a series structure is considered to be a voltage generator. In a shunt fed structure, a signal is fed to conductor loop at two points without creating a gap. Signal feeding to a shunt structure is considered to be a current generator.

FIG. 3 shows a well known toroidal radiation pattern for a dipole antenna. It is readily appreciated that an electrical component of the electromagnetic wave forms a vertical radiation portion and the magnetic component forms a horizontal plane portion.

The design of non-traditional shaped antennas is not easy to analyze and are approximated by various design parameters. Variations away from traditional antenna structures have resulted in low efficiency antennas. In the past, non-traditional designs have been used in low frequency applications. As a result, necessarily poor performance of these antennas was adequate and was acceptable.

FIG. 2 shows cylindrical antenna 104 comprising a cylindrical band 105 with a gap 106 and feed points 107. The circular or tubular radiator of FIG. 1 is replaced by a larger surface area cylinder band 105. The radiation surface of band 105 is clearly increased over that of loop 101 of FIG. 1. For the antenna of FIG. 2, current distribution becomes concentrated opposite the input/output terminals 107, creating an undesirable cardioid pattern, i.e., providing negligible radiation to a substantial portion of an outward radiation plane leading to an undesirable asymmetric antenna radiation pattern. The prior art teaches that multiple feeds should not be made to an antenna where such feed points are less than a wavelength apart as coupling between/among the feed points is strong and in essence eliminates the benefits of multiple feeds, i.e., that the radiation from such an antenna would be the same as if it were made by one feed.

SUMMARY OF THE INVENTION

The invention antenna departs from the prior art loop dipole devices of FIG. 1 and FIG. 2 and the radiation components of FIG. 3, in that the radiation patterns of the electrical and magnetic fields of the invention antenna are switched so that an electrical component of the electromagnetic wave forms a horizontal plane radiation and the magnetic component forms a vertical plane radiation. The invention antenna preserves the general size and form factor of the prior art loop antennas while providing the benefits of multiple point feeds at less than one wavelength in separation of feed points. The invention antenna obtains omnidirectional radiation and improved efficiency over the prior art.

The invention antenna provides for two gaps in a cylindrical or rectangular conductor wall structure, where, in top view, the two gaps separate two mirror image structures. This symmetrical arrangement allows for even current distribution across the entire device and that overall efficiency is increased when feed points are placed a distance away from the edges defining the gaps. It is preferred that a high-impedance network of balanced transmission lines be used to feed the invention antenna.

In a specific example, a circumferential distance along a continuous conductor surface between feed points in the invention antenna is one quarter wavelength or a total circumference distance around the cylinder or reactance of about 0.6 wavelength. A distance defined by the gaps and a section of the conductor wall from the edge of the gaps to the feed points equals about 0.1 wavelength. The shape and size of the invention antenna causes it to operate as two back-to-back folded dipole antennas that are a quarter wavelength long. The combination of folded dipoles in the invention antenna provides an omnidirectional radiation pattern, eliminating the cardioid pattern deficiencies in prior art dipole antennas. The invention antenna radiates essentially as a magnetic dipole device.

It is an object of the present invention to provide structures and methods whereby efficiency of increases over a similarly formed loop antenna by at least five percent.

It is a further object of the invention to provide a small loop or folded dipole antenna fed at multiple points with high-impedance, balanced transmission lines to achieve an efficient radiator where the gain almost equals the directivity.

It is a further object of the invention to feed a loop antenna at multiple points by way of a spaced apart transmission line to provide a more efficient radiator with gain almost equal to the directivity of the beam patterns.

It is a further object of the invention to provide a loop antenna fed with relatively large cross-section transmission lines spaced apart to provide additional signal radiation surface area or a feed antenna structure to the loop antenna.

BRIEF DESCRIPTION OF THE DRAWINGS

FIG. 1 is a perspective view of a prior art loop antenna.

FIG. 2 is a perspective view of a cylinder form of the antenna of FIG. 1.

FIG. 3 is a perspective view of a toroid radiation of a dipole antenna, where an electrical component is shown vertically oriented and a magnetic component is shown horizontally oriented.

DETAILED DESCRIPTION OF THE INVENTION

The invention is now discussed with reference to the figures.

Figure 4:
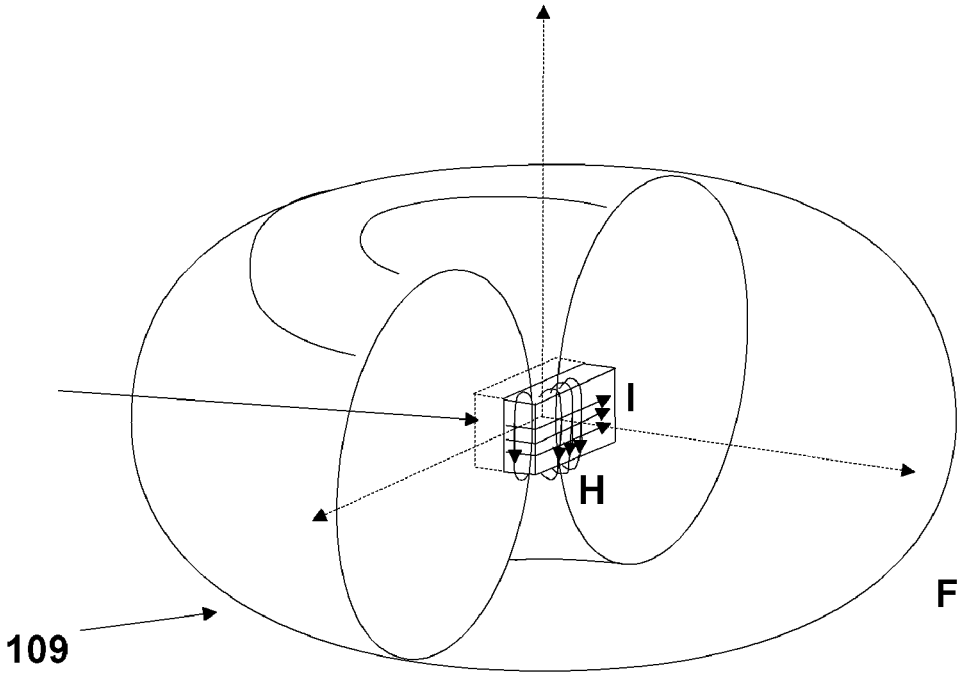
FIG. 4 is a perspective view of a toroid radiation pattern for the invention antenna, where an electrical component is shown horizontally oriented and a magnetic component is shown vertically oriented.

FIG. 4 is a perspective view of a toroid radiation pattern for the invention antenna, where an electrical component current I is shown horizontally oriented and a magnetic component H is shown vertically oriented. This is in contrast to the opposite orientations of components H and I shown in FIG. 3 for a dipole antenna. Although similar in form factor to the prior art loop antennas, the invention antenna is fundamentally operating to radiate is electromagnetic waves in a very different manner. Operating by way of multiple feeds to the radiating surfaces at feed points less than one wavelength apart has resulted in this stark change in pattern of radiation of components of electromagnetic waves in the invention antenna.

Figure 5:
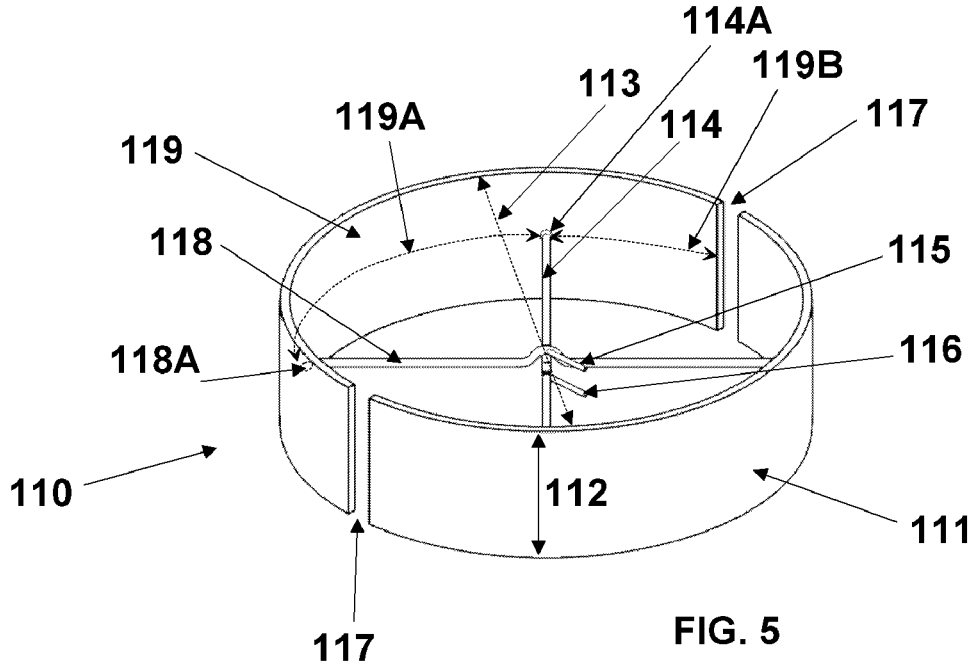
FIG. 5 is a perspective view of the invention antenna in a cylindrical form.

FIG. 5 is a perspective view of the invention antenna 110 comprising two generally cylindrical half sections 111 and 119 separated by gaps 117 and each having a conductor wall height 112. Height 112 is preferably greater than one centimeter. Diameter 113 is a consequence of design choices with respect to arc separation 119A separating feed points 118A and 114A for feed conductors 118 and 114 respectively to half section 118. Identical orientation for feed points is made upon an inside surface of half section 111 for feed conductors 118 and 114. Separation 119A is preferably about one fourth wavelength for the desired antenna operational range of frequencies. Arc distance 119B is a distance between feed point 114A and an edge of gap 117. Said arc distance is identical for all the feed points from a gap edge on the inside surfaces of half sections 111 and 118. Feed conductors 114 and 118 are respectively fed by way of feed lines 116 and 115. Providing signal feed to one of feed lines 115 or 116 necessarily drives the operation of the invention antenna where the other feed line is connected to ground. Four arc distances (of which arc distance 119B is one) and a distance across gaps 117 equal about 0.1 to 0.25 wavelength for the desired antenna operational range of frequencies for the invention antenna. Gap distances 117 are preferably about ten percent or less of the total of four arc distances (of which arc distance 119B is one) and a distance across gaps 117. In a specific example, diameter 113 is 20 inches and wall height 112 is 7 inches.

Figure 6:
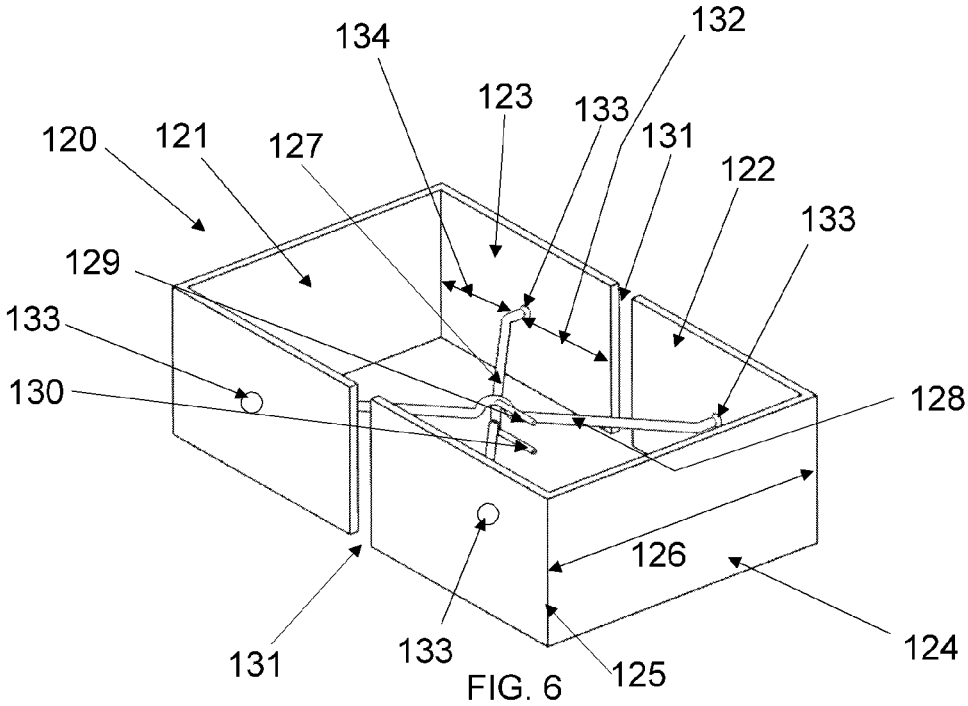
FIG. 6 is a perspective view of the invention antenna in a rectangular form.

FIG. 6 is a perspective view of the invention antenna 120 comprising two generally U-shaped half sections 121 and 124 to form a rectangular shape overall but separated by gaps 131. Each of half sections 121 and 124 have a conductor wall height 125 and a width 126 of their end walls. Height 125 is preferably greater than one centimeter. An overall length of antenna 120 includes gaps 131, wall distances 132 between gap edges and feed points 133, and wall distances 134 between feed points 133 and said end walls. Feed conductors 127 and 128 respectively connect feed lines 130 and 129 to said feed points 133. Width 126 plus twice distance 134 is preferably about one fourth wavelength for the desired antenna operational range of frequencies. Providing signal feed to one of feed lines 129 or 130 necessarily drives the operation of the invention antenna where the other feed line is connected to ground. Four distances 132 and a distance across gaps 131 equal about 0.1 to 0.25 wavelength for the desired antenna operational range of frequencies for the invention antenna. Gap distances 131 are preferably about ten percent or less of the total of four distances 132 plus two gap distances 131.

Figure 7:
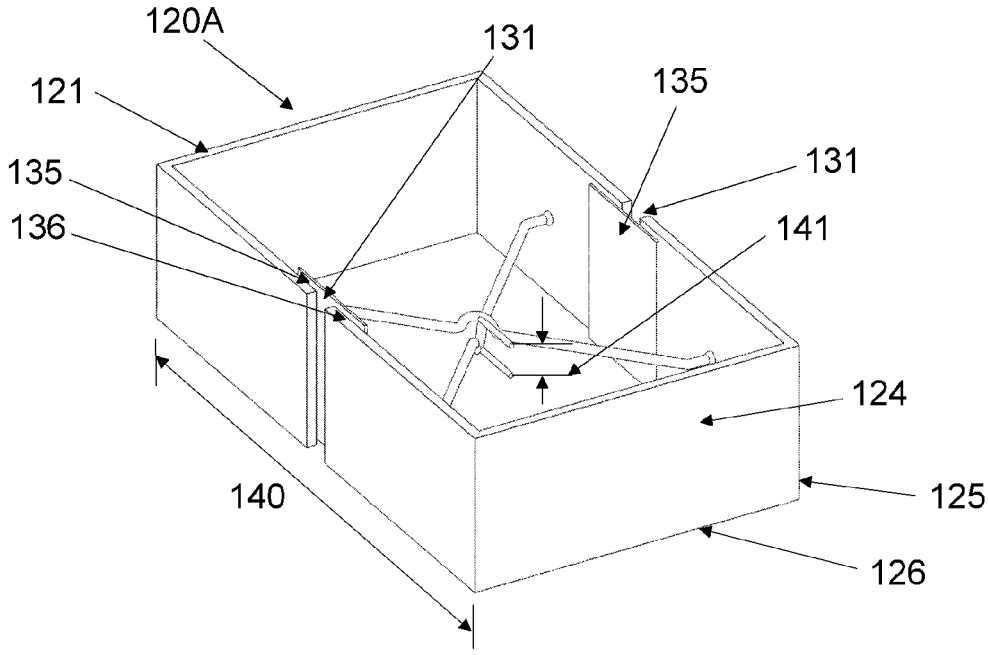
FIG. 7 is the invention antenna of FIG. 6 incorporating capacitance across the two gaps.

FIG. 7 is the antenna 120 of FIG. 6 incorporating capacitors across the two gaps 131, where conductive plates 135 are arranged so that each is identical in size and orientation as to gaps 131. Plates 135 are secured to an inside surface of half sections 121 and 124 near gaps 131 and separated from them by capacitive distance 136, which is preferably filled with a dielectric substance for support and capacitive effect. Overall capacitance of each plate 135 is preferably with the range of 10 to 20 picofarads, more preferably at about 14 picofarads in a specific embodiment. Said capacitance in the entire circuit structure (1) allows for tuning an operating center frequency for the invention antenna and (2) lowers the operating center frequency of the antenna. As a specific example of this embodiment of the invention VOR antenna, overall length 140 of the rectangular structure is about 26 inches, width 126 is about 5 inches, and height 125 is about 7 inches.

FIG. 7 shows a separation distance 141 of feed lines 129 and 130 and feed conductors 127 and 128 (of FIG. 6), which provides a substantial separation (i.e., about 0.5 inches to 1.0 inches) of these conductors in contradiction to the teaching of the prior art. The '897 patent teaches a currently well-known design paradigm of using "closely spaced conductors" for feed lines and feed conductors in an attempt to neutralize radiation from them. The invention antenna maintains a substantial separation of those conductors to improve overall performance, in combination with using high impedance, spaced-apart feed lines and feed conductors. Separation distance 141 of feed lines and feed conductors results in increasing the effective radiating surface of the antennas of the invention, thereby reducing overall size thereof over the prior art antennas.

A further advantage of the in invention antenna as shown in FIG. 7 is use of a high Q air capacitor in the antenna loop, resulting in uniform current distribution across the radiator surfaces. Arranging feed points 133 (as in FIG. 6) to be separated from each other at one quarter wavelength apart effectively reduces the resonant frequency of the antenna. This, in turn, results in significant size reduction of the overall antenna as to a peripheral size.

The '897 patent teaches that each feed line should be connected to a two dimensional radiator at it's end point and that each feed line should be connected to one or two radiators which share no connection with radiators of the other feed line. In the present invention, two back-to-back, concave and symmetrical three-dimensional radiators are fed with inputs from both feed lines at a mid-point of a height of the antenna. With such dual feeds to a single radiating element, antenna efficiency is improved over the prior art.

In a further distinguishing feature of the invention, the periphery of the new antenna is less than half wavelength. The antenna of the '897 patent is a full wavelength in effective length. The present invention antenna provides an efficient omnidirectional loop type radiation from a dipole like type radiator by careful selection of the capacitance linking the three dimensional dipole elements.

Figure 8:
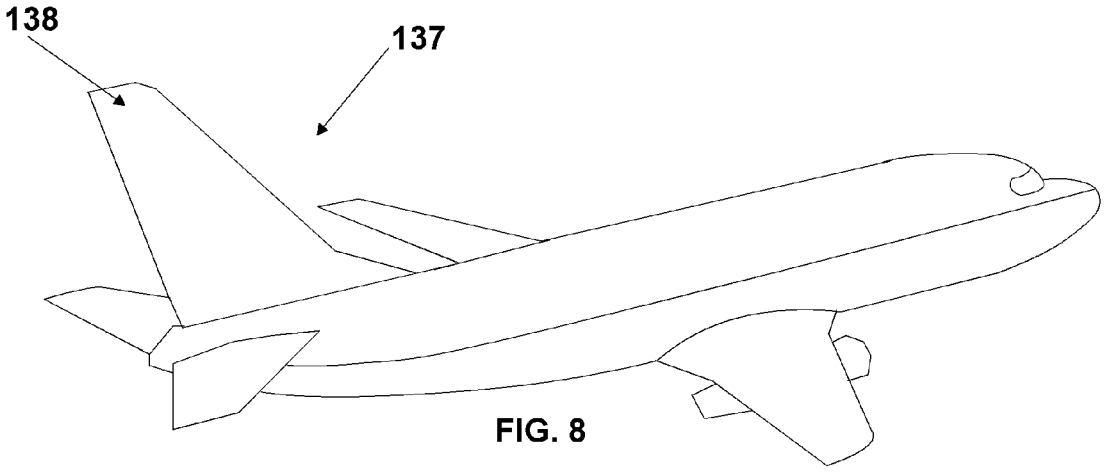
FIG. 8 shows a tail fin location on a commercial airplane as a preferred location for the invention antenna as a receiver.

FIG. 8 shows a tail fin location 138 on a commercial airplane 137 as a preferred location for the invention antenna as a portion of a receiving device for radio communications.

Figure 9:
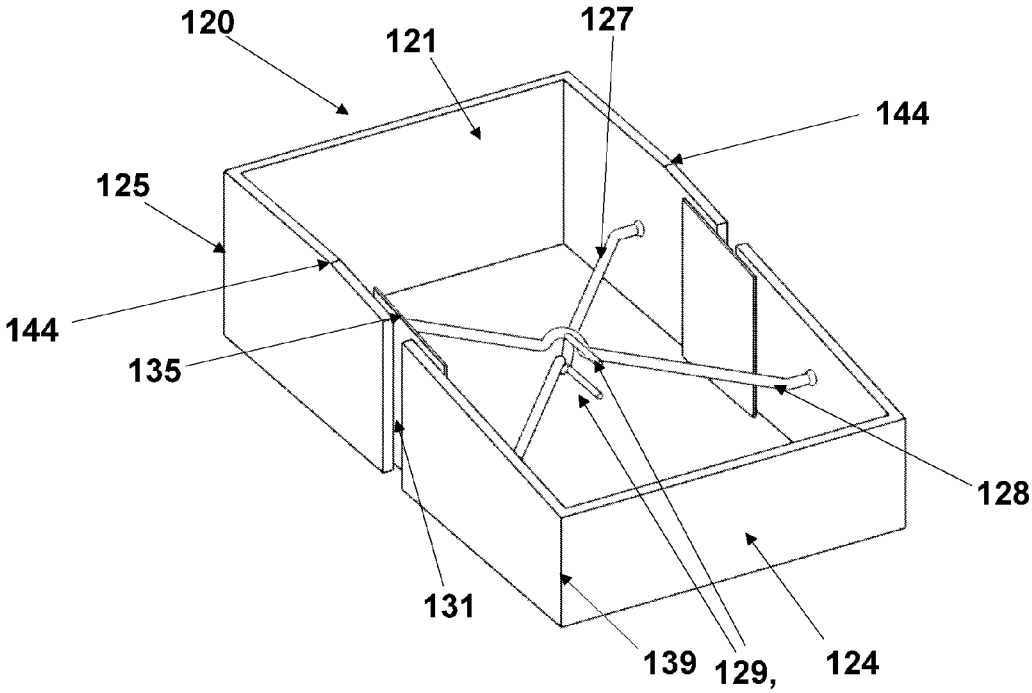
FIG. 9 shows a sloped form of the invention antenna of FIG. 7.

FIG. 9 shows a sloped form of the invention antenna 120 of FIG. 7, where height 125 is reduced starting at point 144 on side walls of half section 121, continuing down across gap 131, plate 135 at down side walls of half section 124 so its endwall has a height 139. This sloped form of the invention antenna somewhat reduces efficiency while providing for incorporation into a most distal end of the tail fin location 138 of FIG. 8. Height 139 is about 4 inches in a specific example continued from above.

It is a further object of the invention that the invention antenna operates as transmission antennas and reception antennas for modern jetliner navigation. VOR stands for VHF Omni-directional Radio Range. It is a jetliner radio navigation system. These systems broadcast a VHF radio composite signal including the station's morse code identifier and data that allows the airborne receiving equipment to derive the magnetic bearing from the station to the aircraft. An intersection of two radials from different VOR stations on a chart allows for a determination of a specific position of the aircraft.

A preferred embodiment of the current invention is as a VOR receiving antenna in the fin cap of an aircraft as in FIG. 9. It is sloped to conform to the shape of the top of the fin. VOR signals are horizontally polarized at a center frequency of 112.975 MHz. A frequency of 112.975 MHz corresponds to a wavelength of 2.66 m. A traditional dipole with horizontal polarization would yield nulls in the fore and aft directions of the aircraft. Nulls in this direction are unacceptable. However, the current invention yields a "loop"-like pattern where the nulls are directly overhead and directly below the aircraft. Nulls in this direction are acceptable because of the "cone of uncertainty" associated with VOR ground stations.

The size of the fin cap for any particular aircraft is fixed. The preferred embodiment allows the design of an antenna that occupies the budgeted volume of a VOR antenna. By occupying the budgeted volume, the antenna is optimally efficient. The resonant frequency of the antenna is decreased to coincide with the center frequency (112.975 MHz) of the VOR band by the use of high-Q dielectric capacitors. The radiators are excited by a feed network of balanced, high-impedance transmission lines.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

We claim:

1. An antenna, comprising:

an antenna element comprising an open ended conductive cylinder divided into two half parts at a plane passing through a cylinder axis to define two longitudinal slots, and two conductors, wherein each half part of the antenna element includes a plurality of spaced-apart feed points, wherein the each half part is connected to two ends of the two conductors at the spaced-apart feed points separated by a quarter of an operating wavelength of the antenna element and at about a mid-height of the cylinder, wherein the two conductors extend from the two ends at the spaced-apart feed points at the half part to the two ends at the spaced-apart feed points on the other half part of the antenna element such that the two conductor pass through the cylinder axis.

2. The antenna of claim 1, wherein the two conductors do not directly contact one another and are separated by a substantial separation distance at the cylinder axis.

3. The antenna of claim 2, wherein two feed lines separately connect with different conductors at about the cylinder axis.

4. The antenna of claim 3, wherein the two feed lines are high impedance.

5. The antenna of claim 4, wherein, in operation, the two half parts are joined electrically by capacitance means which extend across the longitudinal slots.

6. The antenna of claim 4, wherein a cylinder diameter is about 20 inches and the cylinder height is about 7 inches.

7. An antenna, comprising:

an antenna element comprising a rectangular, open ended, conductive box divided into two half parts at a plane passing through a vertical box axis at half a length of the box to define two longitudinal slots, and two conductors, wherein each half part of the antenna element includes a plurality of spaced-apart feed points, wherein the each half part is connected to two ends of the two conductors at spaced-apart feed points separated by a quarter of an operating wavelength of the antenna element and at about a mid-height elevation of the box, wherein the two conductors extend from the two ends at the spaced-apart feed points at the half part to the two ends at the spaced-apart feed points on the other half part of the antenna element such that the two conductor pass through the box axis.

8. The antenna of claim 7, wherein the two conductors do not directly contact one another and are separated by a substantial separation distance at the box axis.

9. The antenna of claim 8, wherein two feed lines separately connect with different conductors at about the box axis.

10. The antenna of claim 9, wherein the two feed lines are high impedance.

11. The antenna of claim 10, wherein, in operation, the two half parts are joined electrically by capacitance means which extend across the longitudinal slots.

12. The antenna of claim 10, wherein the box has an overall box length, a box width, and a tallest half part has a first height at a non-slotted first wall which is greater than a second height at an opposing non-slotted second wall.

13. The antenna of claim 12, wherein slotted opposing walls of the box decrease in height linearly from the first height to the second height as they extend from the first wall to the second wall.

14. The antenna of claim 13, wherein the box length is about 20 inches, the box width is about 5 inches, the first height is about 7 inches, and the second height is about 4 inches.

* * * * *